US007497327B2

(12) United States Patent
Martinez et al.

(10) Patent No.: US 7,497,327 B2
(45) Date of Patent: Mar. 3, 2009

(54) WALLBOARD FINISHING SYSTEM

(75) Inventors: Steven M. Martinez, Charlotte, NC (US); Lee Holder, Charlotte, NC (US)

(73) Assignee: National Gypsum Properties, LLC, Charlotte, NC (US)

( * ) Notice: Subject to any disclaimer, the term of this patent is extended or adjusted under 35 U.S.C. 154(b) by 46 days.

(21) Appl. No.: 11/495,511

(22) Filed: Jul. 28, 2006

(65) Prior Publication Data

US 2007/0029215 A1 Feb. 8, 2007

Related U.S. Application Data

(60) Provisional application No. 60/704,575, filed on Aug. 2, 2005.

(51) Int. Cl.
*B65D 69/00* (2006.01)

(52) U.S. Cl. ..... 206/225; 206/234; 206/349; 206/560; 206/561; 220/735

(58) Field of Classification Search ..... 206/321, 206/349, 223, 225, 234, 560, 561; 15/236.07, 15/235.04, 235.7; 30/169; 118/40, 43; 220/695, 220/697, 735, 737, 698, 212
See application file for complete search history.

(56) References Cited

U.S. PATENT DOCUMENTS

| | | | | |
|---|---|---|---|---|
| 5,186,329 | A * | 2/1993 | Fogelberg | 206/372 |
| 5,242,495 | A * | 9/1993 | Hammond et al. | 118/43 |
| 5,540,329 | A * | 7/1996 | Vogeley | 206/373 |
| 5,626,272 | A * | 5/1997 | Klemansky | 206/373 |
| 5,669,498 | A * | 9/1997 | Fierek et al. | 206/373 |
| 5,732,821 | A * | 3/1998 | Stone et al. | 206/370 |
| 2002/0096527 | A1 * | 7/2002 | Arenas et al. | 220/697 |
| 2006/0124505 | A1 * | 6/2006 | Hanson | 206/349 |

* cited by examiner

*Primary Examiner*—Luan K Bui
(74) *Attorney, Agent, or Firm*—Ice Miller LLP

(57) ABSTRACT

A system for applying wallboard finishing compound comprising a container with an opening and tray sized and shaped to fit within the opening. The tray has a first chamber for receiving the wallboard finishing compound and a second chamber having a grip formed therein. The tray is further shaped to receive a joint knife and a roll of tape. A lid is sized and shaped to cover the opening and enclose the tray in the container.

7 Claims, 6 Drawing Sheets

WALLBOARD FINISHING SYSTEM

This application claims priority to U.S. Provisional Application No. 60/704,575, filed Aug. 2, 2005, herein incorporated by reference.

BACKGROUND OF THE INVENTION

The present invention relates to drywall or wallboard finishing tools and especially to a system or kit for finishing wallboard.

Installation of wallboard typically involves finishing the joints between adjacent wallboard panels using joint compound to conceal the joint. Joint compound is often prepared or is available ready-mixed in relatively large containers—e.g., a conventional 5 gallon pail. A portion of the joint compound is then loaded into a shallow "mud pan" or onto a "hawk" for use. A layer of joint compound is applied over the wallboard joint using a joint finishing knife. A strip of reinforcing tape is placed over the joint and is embedded in the joint compound by applying a thin top coat of joint compound over the tape with the knife. The joint compound is allowed to dry and is then scraped and sanded to smooth its surface. Second and third coats of joint compound may be applied to the joint to feather the edges of the joint compound and blend the finished joint into the wallboard. After each coat, the surface of the joint compound is smoothed using a sanding block.

Many users undertaking home improvement and other wallboard installation projects often lack one or more of the numerous tools or supplies required. In addition, one or more tools and supplies frequently become lost or misplaced. Accordingly, there is a need for a system or kit that provides and organizes all of the tools and supplies needed for finishing wallboard.

BRIEF SUMMARY OF THE INVENTION

These needs and other needs are satisfied by the present invention, which comprises a system for applying wallboard finishing compound, comprising a container having an opening and a tray sized and shaped to fit within the opening. The tray has a chamber for receiving the wallboard finishing compound and a grip for holding the tray. In an alternative embodiment, the tray includes a first chamber for receiving the wallboard finishing compound and a second chamber, the grip formed in the second chamber.

In yet another embodiment, the system further comprises a joint knife for applying the wallboard finishing compound, a roll of tape and a lid, the tray shaped to receive the joint knife and the roll of tape, and the lid sized and shaped to cover the opening and enclose the tray in the container.

DETAILED DESCRIPTION OF THE INVENTION

Figure 1:
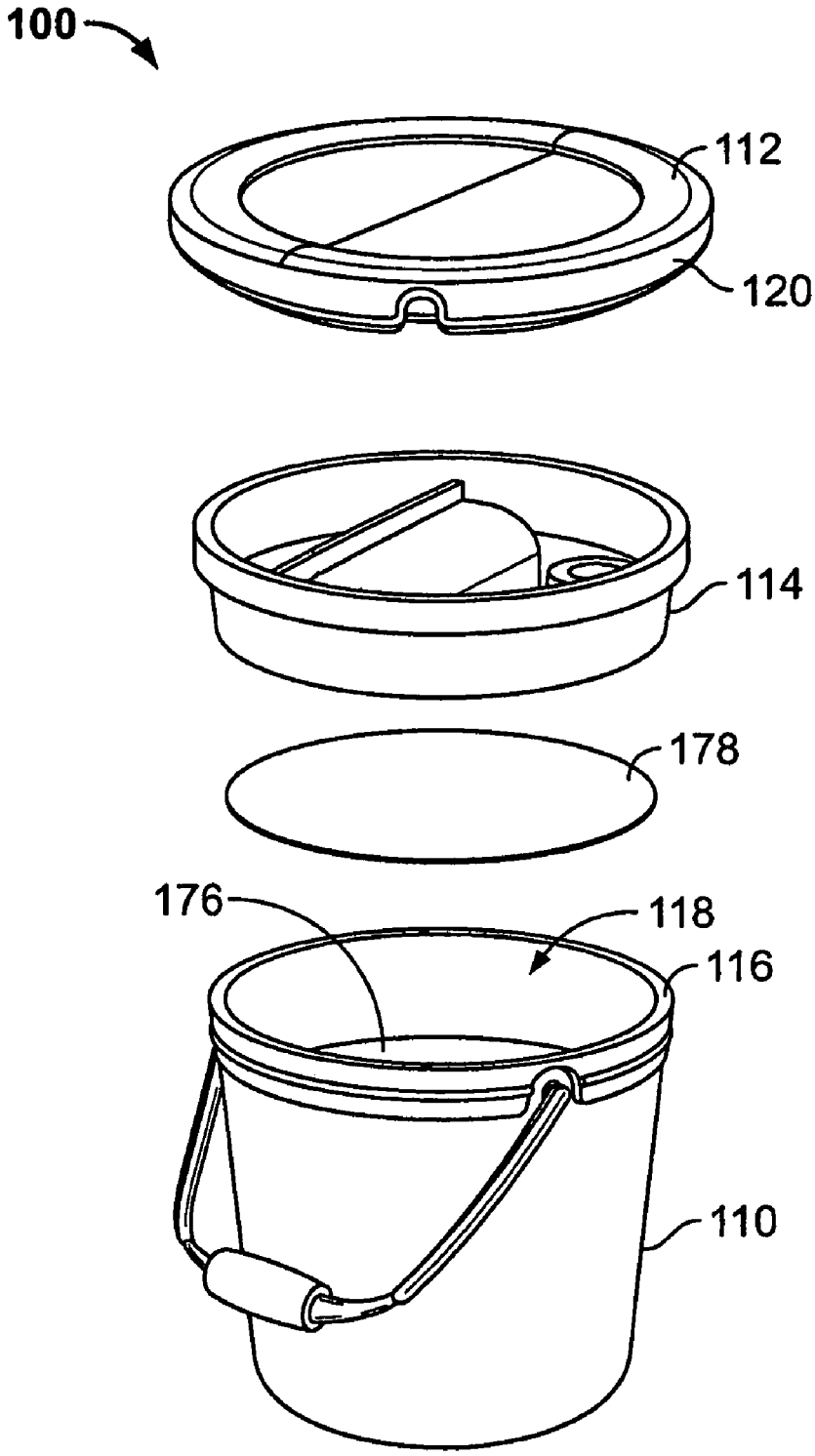
FIG. 1 is an exploded perspective view of a wallboard finishing system.

Referring to FIGS. 1-4, a system or kit 100 for applying wallboard finishing compound is described, comprising a container 110, a lid 112 and a tray 114. As shown in FIG. 1, container 110 is a conventional 5 gallon pail or bucket having a rim 116 defining an opening 118. Lid 112 is a conventional snap fit lid having a peripheral wall 120 that extends over rim 116 when lid 112 is fitted over opening 118 of container 110. The interior circumference of wall 120 is provided with a lip (not shown) that engages rim 116 to snap fit lid 112 to container 110. In an alternative embodiment, lid 112 may be adapted to engage rim 116 by other means known in the art. For example, the interior circumference of wall 120 may be threaded to engage rim 116. Those of skill in the art will further appreciate that container 110 may be of larger or smaller size with a correspondingly sized lid 112.

Figure 3:
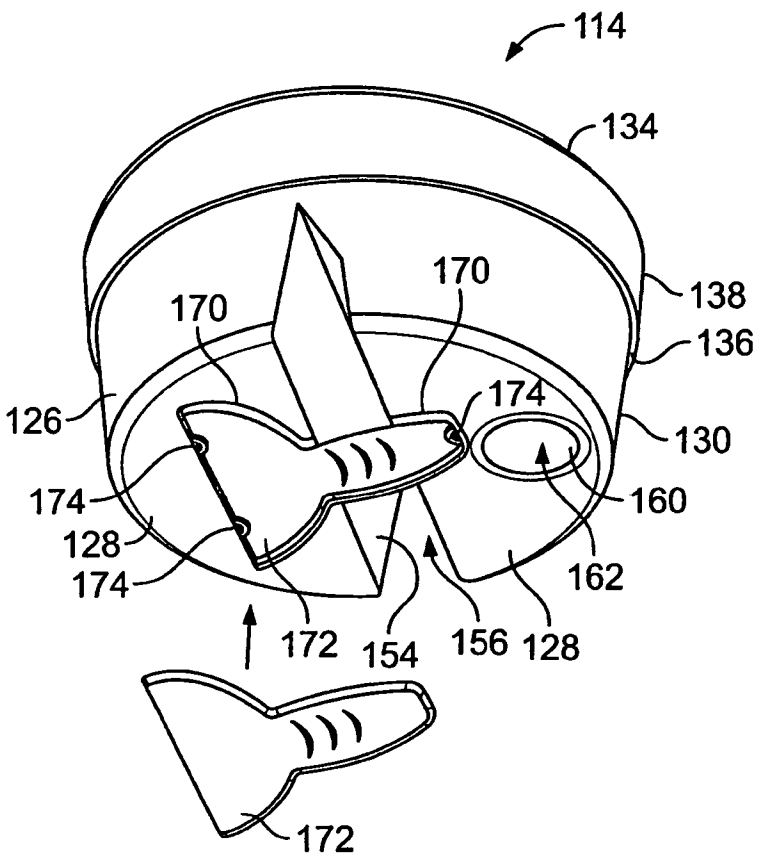
FIG. 3 is a bottom perspective view of the tray of FIG. 2.
Figure 2:
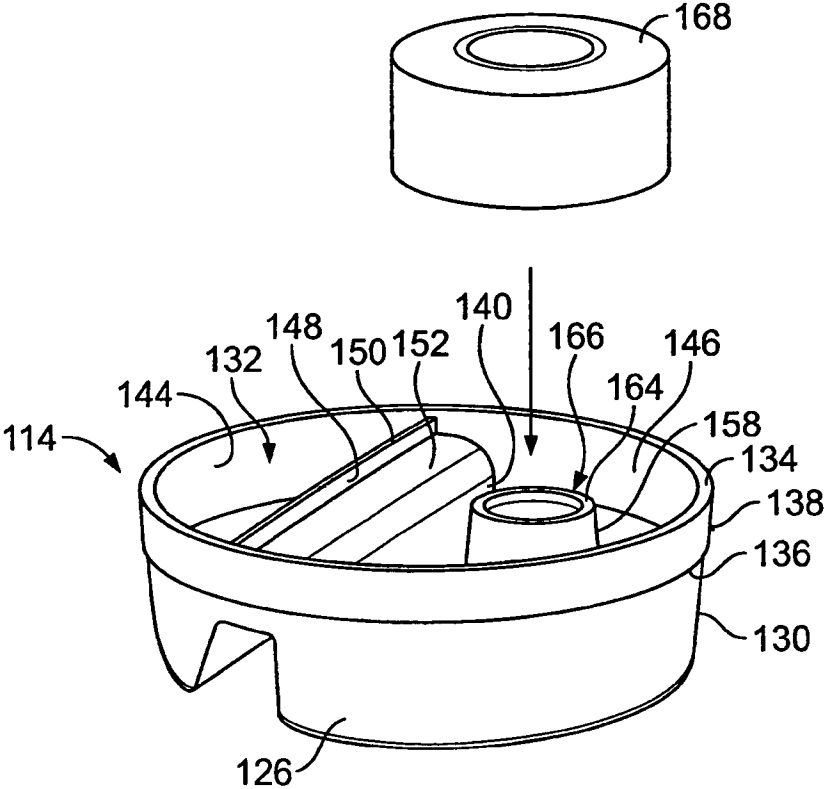
FIG. 2 is a top perspective view of the tray of the wallboard finishing system of FIG. 1.
Figure 4:
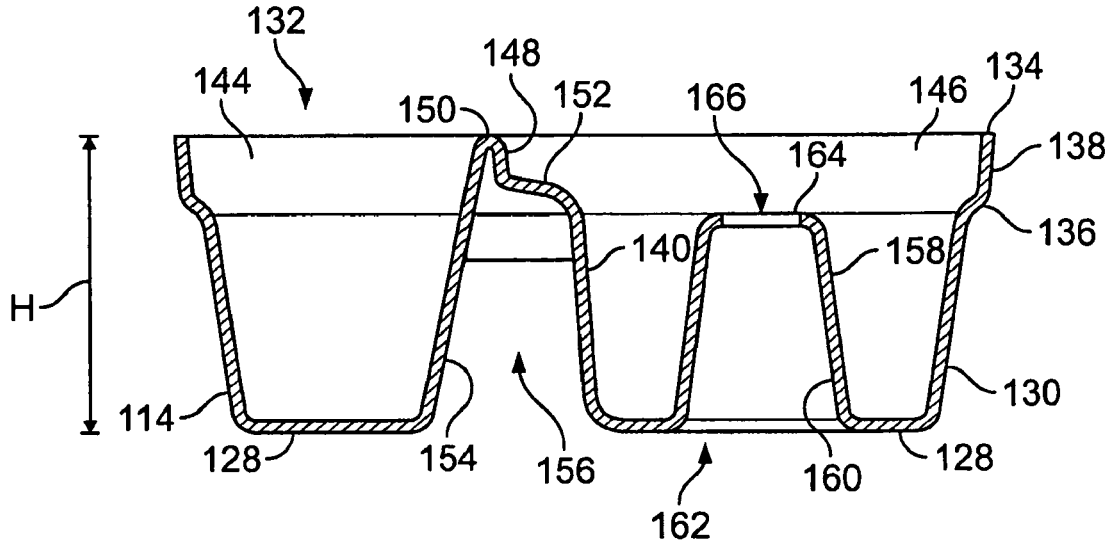
FIG. 4 is a side elevation section view of the tray of FIG. 2.

As shown in FIGS. 2-4, tray 114 has a body 126 with a bottom 128 and sidewalls 130 that define an opening 132. Body 126 is sized and shaped to fit within opening 118 of container 110. Sidewalls 130 are provided with a rim 134 for supporting tray 114 within opening 118 in container 110. As best shown in FIG. 4, rim 134 forms a shoulder 136 with an outer circumference 138 that is larger than the circumference of opening 118. When tray 114 is inserted into opening 118 of container 110, shoulder 136 rests atop rim 116 of the container to support the tray within the opening of the container. Rim 134 of tray 114 and wall 120 of lid 112 are sized such that when tray 114 is inserted in the opening 118 of container 110, lid 112 may be snap fit on container 110 with the lip of lid 112 engaging rim 116 to enclose the tray in the container (not shown).

Figure 5:
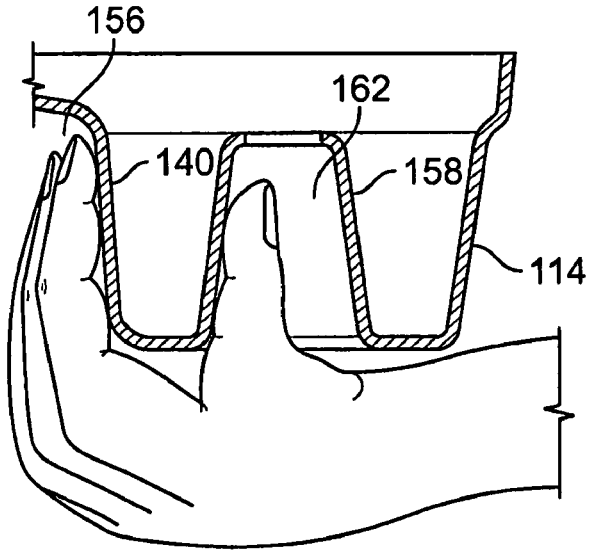
FIG. 5 is a detail section view of the tray of FIG. 4, showing a user's hand grasping the tray.

As best shown in FIGS. 2 and 4, a dividing wall 140 projects from the bottom 128 of tray 114, that cooperates with sidewalls 130 to form separate chambers 144, 146 within the tray. The top 152 of dividing wall 140 has a ridge 148 with a relatively sharp edge 150. The bottom surface 154 of dividing wall 140 defines a cavity 156 that is sized and shaped to allow the user to insert his fingers into the cavity when holding tray 114 (FIG. 5).

A spindle 158 projects from the bottom 128 of tray 114, into chamber 146. The bottom surface 160 of spindle 158 defines a cavity 162 that is sized and shaped to allow the user to insert his thumb into the cavity when holding tray 114 (FIG. 5). In a preferred embodiment, spindle 158 is conical and has a top 164 with an aperture 166. Aperture 166 facilitates the insertion of tray 114 into container 110 by allowing air to escape as the tray is inserted into the container. As shown in FIG. 2, chamber 146 and spindle 158 are sized and shaped such that a conventional roll of wallboard tape 168, such as a standard 75' roll of tape, may be threaded over spindle 158 and received in chamber 146.

As shown in FIG. 3, bottom 128 of tray 114 is further provided with a recess 170 that is sized and shaped to receive a wallboard finishing tool, such as a conventional 6" flexible joint knife 172 (Red Star 4000, Hyde Tools, Inc., Massachusetts). A plurality of tabs 174 are provided at the edges of recess 170 such that joint knife 172 is retained within recess 170. Tabs 174 may by formed and positioned to hold joint knife 172 by friction fit, snap fit or by other means known in the art.

In a preferred embodiment, tray 114 has a height "H" of about 3.5 inches (FIG. 4). Tray 114 is made of high density polyethylene formed by injection molding or by other means known in the art. In an alternative embodiment, tray 114 may be made of other materials, such as metal, including steel and aluminum formed by stamping or other suitable means.

System 100 is assembled by partially filling container 110 with gypsum 176 or other joint compound material, either as a prepared ready mix compound or in dry form for mixing with water. Joint knife 172 is snap fit within recess 170 of tray 114 and a roll of wallboard tape 168 is mounted on spindle 158 within chamber 146 of the tray. Tray 114 is then inserted into container 110 as described above, such that bottom 128 of tray 114 is supported above gypsum 176. A doily barrier 178 made of plastic, paper or cardboard may be placed atop gypsum 176 to protect tray 114 and its contents from the joint compound 176 (FIG. 1). Lid 112 is then snap fit over opening 118 of container 110 to enclose tray 114 and joint compound 176 within the container.

Wallboard finishing system 100 may also contain other tools and supplies. In a preferred embodiment, chambers 144 and 146 of tray 114 are used to store one or more additional wallboard tools and supplies (not shown), including sandpaper, a sanding block, work gloves and/or a trowel. In addition, printed instructions for finishing wallboard (not shown) may also be stored in tray 114.

Wallboard finishing system 100 is used by removing lid 112 and tray 114 from container 110. Joint knife 172 is removed from the bottom 128 of tray 114 and at least chamber 144 is emptied of any contents. If necessary, the user prepares the joint compound 176 by adding water and then transfers a portion of the prepared joint compound to chamber 144 of tray 114, which serves as a mud pan. Chamber 146 is shaped to form a grip for holding tray 114. Cavities 156 and 162 formed in the bottom 128 of tray 114 are used to grip tray 114 in one hand (FIG. 5), leaving the other hand free to apply joint compound from chamber 144 to the wallboard work surface using joint knife 172. Alternatively, tray 114 may also be held in the reverse orientation from that shown in FIG. 5, such that cavity 162 and sidewall 130 are used to grip tray 114 and chamber 144 is supported on the user's forearm. In this orientation, the weight of joint compound 176 rests on the user's arm to reduce fatigue and strain while holding and working with tray 114. Edge 150 at the top 152 of dividing wall 140 provides a convenient surface for wiping joint knife 172 to clean off or remove excess joint compound as necessary. Wallboard tape 168 and any other tools and supplies are removed from tray 114 and used as necessary.

Figure 7:
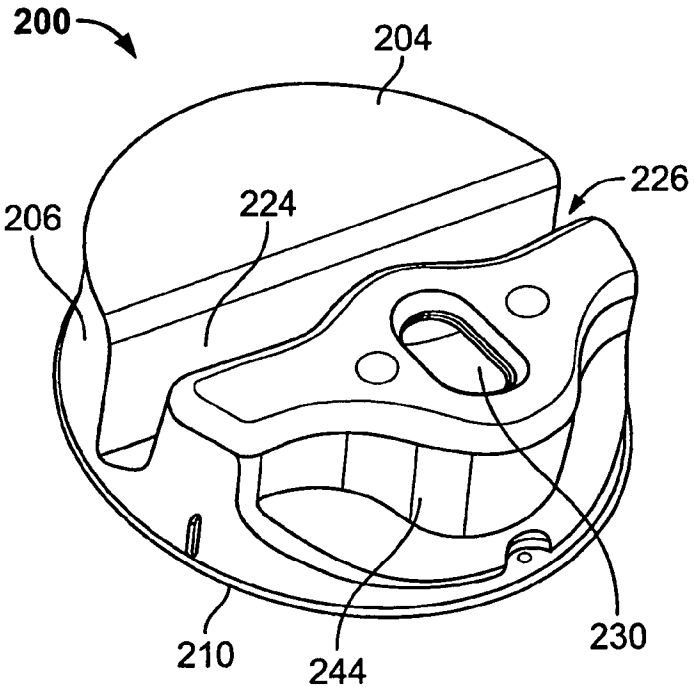
FIG. 7 is a bottom perspective view of the tray of FIG. 6.
Figure 6:
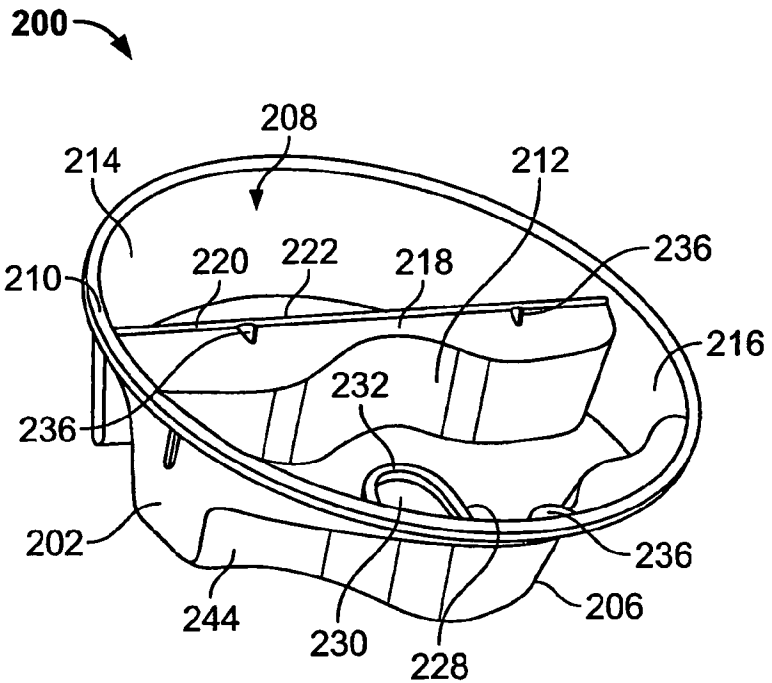
FIG. 6 is a top perspective view of an additional embodiment of the tray.

FIGS. 6-9 show an alternative embodiment of the wallboard finishing system, having a tray 200 with a body 202, bottom 204, and sidewalls 206 that define an opening 208 with a rim 210. A dividing wall 212 projects from the bottom 204 of tray 200, that cooperates with sidewalls 206 to form separate chambers 214, 216 within the tray. The top 210 of dividing wall 212 has a ridge 220 with a relatively sharp edge 222. As best shown in FIG. 7, the bottom surface 224 of dividing wall 212 defines a cavity 226 that is sized and shaped to allow the user to insert his fingers into the cavity when holding tray 200.

Chamber 216 is shaped to form a grip for holding tray 200. An aperture 230 is formed in bottom 204, that is sized and shaped to allow the user's thumb to be inserted through the aperture and into chamber 216 when holding tray 200. Aperture 230 and cavity 226 are used to grip tray 200 in one hand in a manner similar to that shown in FIG. 5 and described above. Alternatively, aperture 230 and sidewall 206 may serve as a grip to hold tray 200 in the reverse orientation, such that chamber 214 is supported on the user's forearm. In a preferred embodiment, aperture 230 has a flange 228 that facilitates the user's grip on tray 200. The outer surface 244 of sidewall 206 may also be ergonomically shaped to improve the user's grip.

Figure 8:
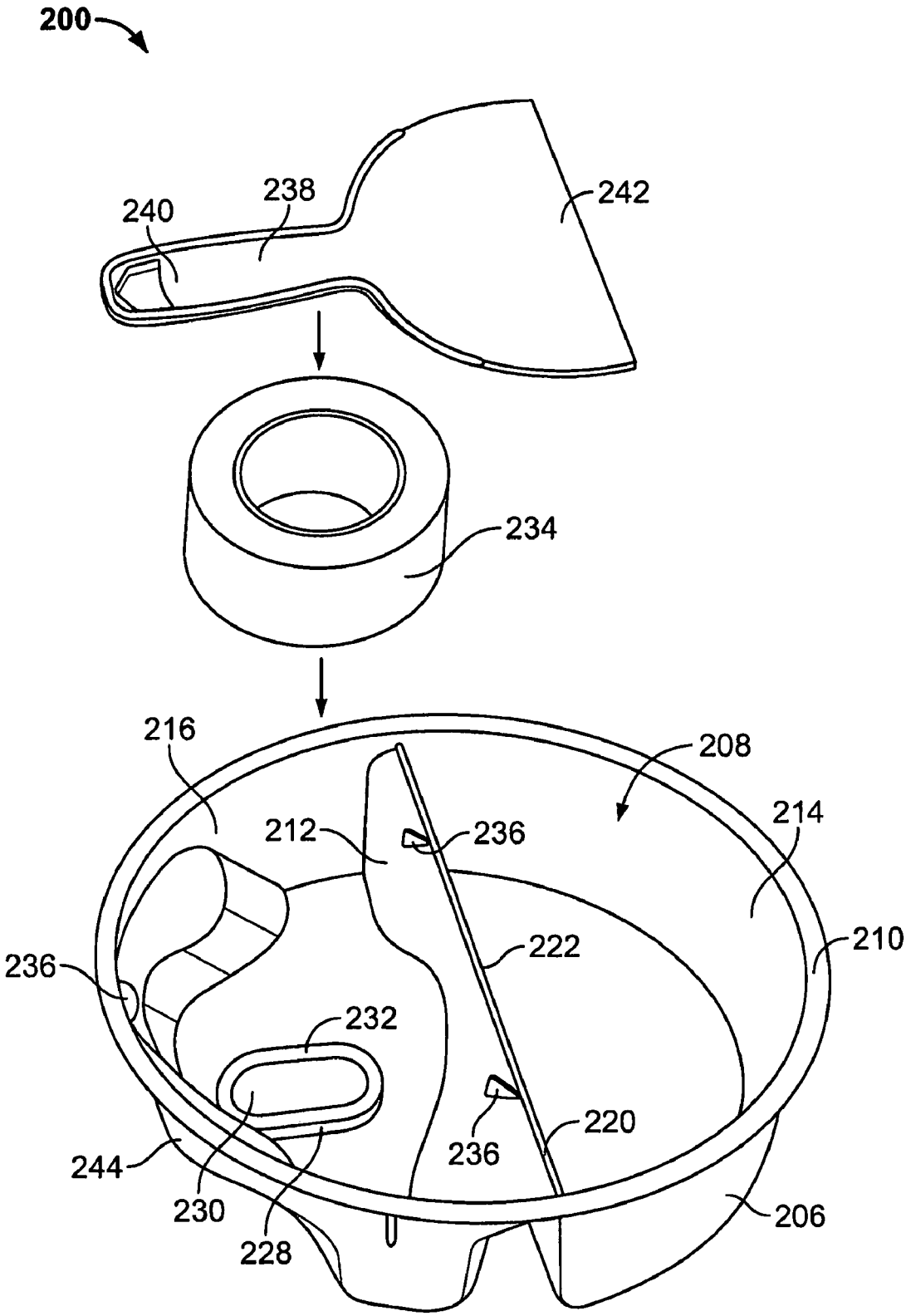
FIG. 8 is a top perspective view of the tray of FIG. 6, showing how tools may be placed within the tray.
Figure 9:
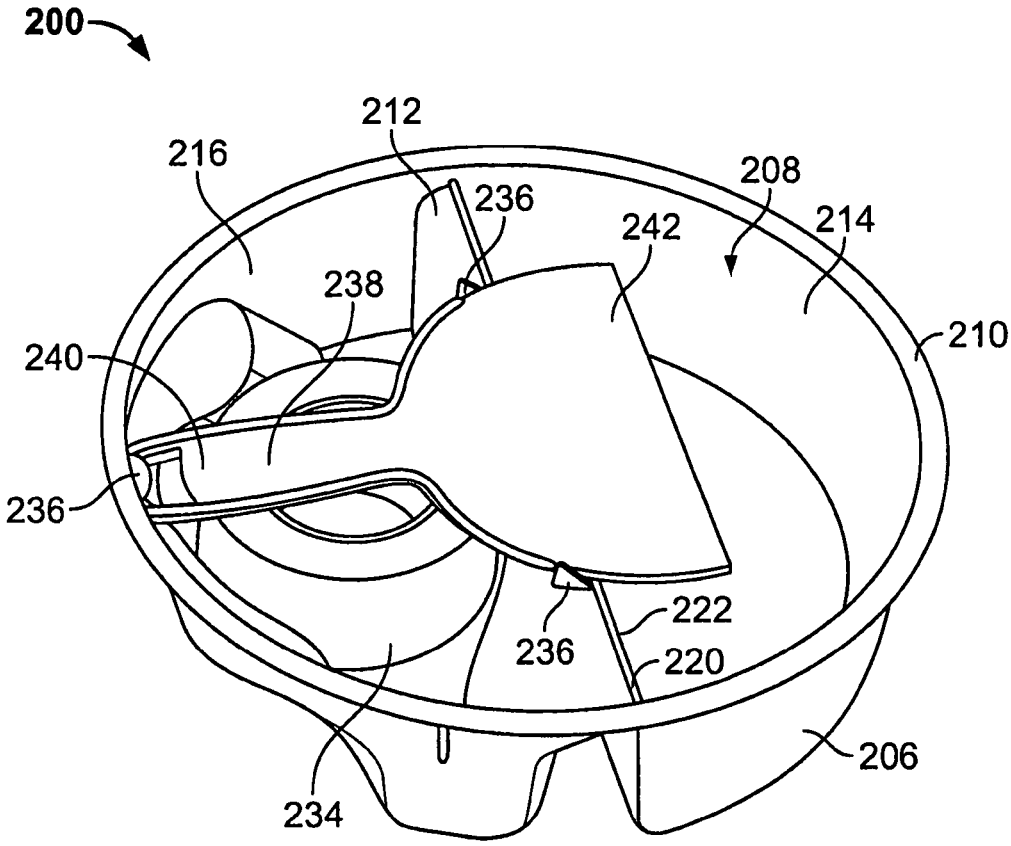
FIG. 9 is a top perspective view of the tray of FIG. 6, showing tools stored within the tray.

As best shown in FIGS. 8 and 9, chamber 216 is sized to receive a conventional roll of wallboard tape 234. In a preferred embodiment, chamber 216 is shaped to conform to the shape of the roll of tape 234 to prevent the tape from shifting position within chamber 216.

Tray 200 is further provided with a plurality of tabs 236 positioned along rim 210 and at the top 218 of the dividing wall 212 to receive a wallboard finishing tool, such as joint knife 238 within the tray. In a preferred embodiment, joint knife 238 is snap fit into tabs 236 such that the handle 240 of the joint knife is positioned along rim 210 of tray 200, while the blade 242 of the joint knife is positioned at the top 218 of dividing wall 212. This embodiment allows the user to store joint knife 238 within tray 200 when the tray is not in use. Those of skill in the art will appreciate that joint knife 238 may be located in various alternative positions within tray 200 by positioning tabs 236 appropriately.

It will be apparent to those of skill in the art that changes and modifications may be made in the embodiments illustrated herein, without departing from the spirit and scope of the invention

What is claimed is:

1. A system for applying wallboard finishing compound, comprising:

a container having an opening;

a tray sized and shaped to fit within said container;

a grip formed in said tray;

a joint knife for applying said wallboard finishing compound, said tray shaped to receive said joint knife;

a roll of tape, said tray shaped to receive said roll of tape; and a lid sized and shaped to cover said opening and enclose said tray in said container;

wherein said tray has a plurality of tabs positioned to receive said joint knife.

2. The system of claim 1, wherein said tray further comprises a first chamber for receiving said wallboard finishing compound and a second chamber shaped to receive said roll of tape.

3. The system of claim 2, wherein said grip comprises an aperture formed in said second chamber.

4. The system of claim 2, wherein said second chamber has an outer surface shaped to form said grip.

5. The system of claim 2, wherein said tray further comprises a wall separating said first and second chambers, said wall having an edge for cleaning said joint knife.

6. The system of claim 1, wherein said joint knife is snap fit to said tray.

7. The system of claim 1, wherein said grip comprises an aperture in said tray.

* * * * *